US006146108A

United States Patent [19]

Mullendore

[11] Patent Number: 6,146,108

[45] Date of Patent: Nov. 14, 2000

[54] PORTABLE PUMP

[76] Inventor: Kevin H. Mullendore, 11407 Auburn Rd., Fort Wayne, Ind. 46845

[21] Appl. No.: 09/302,861

[22] Filed: Apr. 30, 1999

[51] Int. Cl.[7] ..... F04B 41/04

[52] U.S. Cl. ..... 417/234

[58] Field of Search ..... 417/234, 411

[56] References Cited

U.S. PATENT DOCUMENTS

| | | | |
|---|---|---|---|
| D. 309,143 | 7/1990 | Yang | D15/7 |
| 3,243,100 | 3/1966 | Adams | 137/565.18 |
| 3,766,666 | 10/1973 | Stroop | 434/273 |
| 3,910,725 | 10/1975 | Rule | 417/234 |
| 4,187,058 | 2/1980 | Fish | 417/234 |
| 4,389,166 | 6/1983 | Harvey et al. | 417/234 |
| 4,832,013 | 5/1989 | Hartdorn | 128/202.14 |
| 5,295,367 | 3/1994 | Keltner | 62/292 |

*Primary Examiner*—Teresa Walberg
*Assistant Examiner*—Vinod D Patel
*Attorney, Agent, or Firm*—Lundy and Associates

[57] ABSTRACT

A portable pump comprising a box having a bottom and upstanding sides and an open top. The box has a false bottom dividing the box into a lower portion and an upper portion. A box cover is provided for closing the open top. A rechargeable electric battery is positioned in the lower portion of the box. An electrical power line connector is secured to the box and operatively connected to the battery. A charger may be operatively connected to the power line connector as desired. An electric water pump is operatively connected to the battery. The water pump has an inlet and an outlet. The water pump has an outlet hose connector. The upper box portion has dimensions of a size to allow both the pump and the charger to be stored in the upper box portion.

19 Claims, 4 Drawing Sheets

PORTABLE PUMP

BACKGROUND OF THE INVENTION

The present invention relates to portable pumps, and more particularly to a portable submersible battery operated pump mounted in a box for use by handymen, contractors, and emergency personnel.

Portable pumps have been available for some time, however, these pumps usually take one of two forms. The first form is a relatively large bulky portable pump driven by either an electric motor or an internal combustion engine, mounted on skids, or otherwise made portable for use in emergency conditions. These pumps usually cannot be transported from location to location by a single person, and while portable, are generally intended for somewhat extended use like pumping out a basement after flooding, or the like. It is therefore highly desirable to provide a new and improved portable pump. It is also highly desirable to provide a new and improved portable pump which is easily transportable by a single person from location to location at which the pump is used.

A second type of available portable pumps is the extremely small, lightweight pumps which are not designed for continuous use. Generally, these pumps are also not designed for commercial use, but are designed for very light usage such as laboratory use, experimental use and around the home use for short times. The problems with these pumps usually involve their durability. While they are more portable as they are lightweight and can be moved from location to location, they usually have a life of less than twenty four hours when used continuously. It is therefore highly desirable to provide a new and improved portable pump which can be moved from location to location by a single person, and yet durable enough to be used for extended use, and have the durability and capacity for commercial use by contractors and emergency personnel.

Portable pumps have been provided both as submersible pumps and pumps in which neither the pump nor the motor is not submersed. The various advantages and disadvantages of both types of pumps are well known. Because of maintenance considerations, usually, portable pumps are not provided as submersible pumps, and thus, the advantages of submersible pumps have generally not been available in a portable pump. It is therefore highly desirable to provide a new and improved pump in which the pump is a submersible pump.

Most portable pumps are driven by internal combustion engines for a variety of reasons. Foremost is electrical pumps may be hazardous to use around flooded conditions. However, portable pumps driven by internal combustion engines usually require one to carry fuel and may require other maintenance considerations such as oil changes and the like. It is therefore highly desirable to provide a new and improved portable pump which is driven by an electric motor, yet is safe to use in flooded conditions.

Most portable pumps in use if driven by internal combustion engines are tied to the source of fuel during use. Electrical pumps are also tied to a power source and an electrical cord. Neither is particularly convenient in many instances. It is therefore highly desirable to provide a new and improved portable pump which is electric motor driven by a rechargeable storage battery.

Additionally, most portable pumps that have been provided before are of a size and weight that emergency or contractor's trucks do not routinely carry such pumps with them. It is therefore highly desirable to provide a new and improved portable pump driven by an electric motor and a rechargeable battery that has a capacity of from about 10 to about 15 GPM and a size and weight that is no larger than a conventional tool box.

Finally, it is highly desirable to provide a new and improved portable pump which has all of the above features.

SUMMARY OF THE INVENTION

It is therefore an object of the invention to provide a new and improved portable pump.

It is also an object of the invention to provide a new and improved portable pump which is easily transportable by a single person from location to location at which the pump is used.

It is also an object of the invention to provide a new and improved portable pump which can be moved from location to location by a single person, and yet durable enough to be used for extended use, and have the durability and capacity for commercial use by contractors and emergency personnel.

It is also an object of the invention to provide a new and improved pump in which the pump is a submersible pump.

It is also an object of the invention to provide a new and improved portable pump which is driven by an electric motor, yet is safe to use in flooded conditions.

It is also an object of the invention to provide a new and improved portable pump which is electric motor driven by a rechargeable storage battery.

It is also an object of the invention to provide a new and improved portable pump driven by an electric motor and a rechargeable battery that has a capacity of from about 10 to about 15 GPM and a size and weight that is no larger than a conventional tool box.

Finally, it is an object of the invention to provide a new and improved portable pump which has all of the above features.

In the broader aspects of the invention there is provided a portable pump comprising a box having a bottom and upstanding sides and an open top. The box has a false bottom dividing the box into a lower portion and an upper portion. A box cover is provided for closing the open top. A rechargeable electric battery is positioned in the lower portion of the box. An electrical power line connector is secured to the box and operatively connected to the battery. A charger may be operatively connected to the power line connector as desired. An electric water pump is operatively connected to the battery. The water pump has an inlet and an outlet. The water pump has an outlet hose connector. The upper box portion has dimensions of a size to allow both the pump and the charger to be stored in the upper box portion.

DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
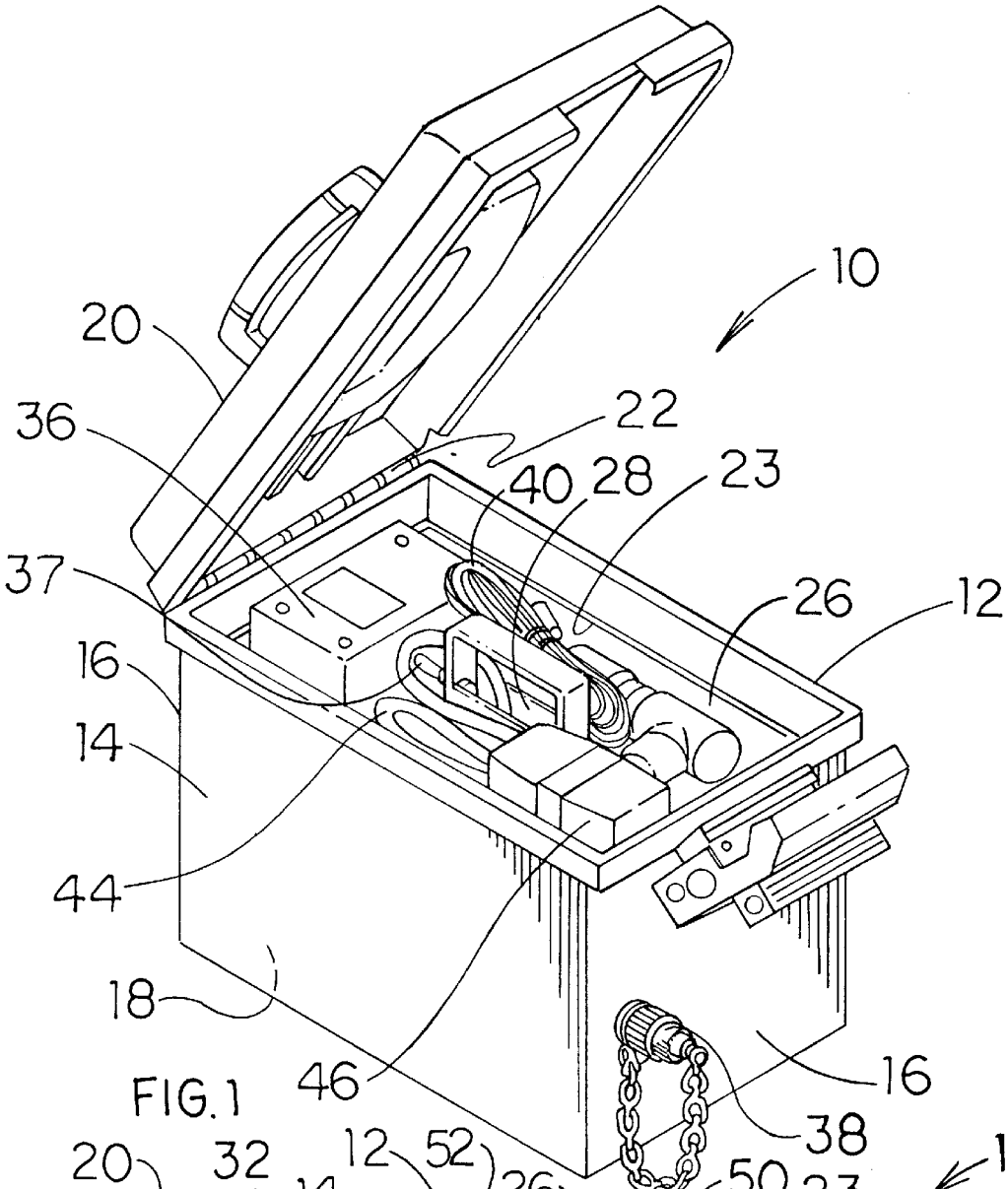
FIG. 1 is a perspective exploded view of the portable pump of the invention with the cover open and the false bottom in place for clarity.

The portable pump of the invention 10 is shown to have a box 12 having upstanding sides 14 and opposite ends 16 and a bottom 18. Box 12 has a hinged cover 20. Cover 20 is connected to one end 16 by a hinge 22 as shown. Box 12 is provided with a false bottom or tray 23 having a bottom 24 and upstanding sides 26. The tray bottom 24 has an elongated slot 28 therein for a purpose to be mentioned hereinafter. The false bottom 23 fits within box 12 as shown in FIGS. 2–7 and is supported between bottom 18 and the cover 20. False bottom 23 thus divides box 12 into a lower portion 30 and an upper portion 32.

In lower portion 30, a battery 34 is secured to bottom 18. Mounted on the end 16 opposite the hinge of cover 20 is a trickle charger and power line connector 38 which is mounted in an opening in end 16. The connector 38 is electrically connected within lower portion 30 to the battery 34, and has both trickle charger and power line connections outside the box 12. Trickle charger 36 may be connected to connector 38 and to the battery 34 when desired. Extending from battery 34 is also pump cable 44 which may be partially stored in lower portion 30 of box 12. Pump cable 44 is connected to the battery 34 through a fuse 35 to an off/on switch 37, and is threaded through opening 28 of false bottom or tray 23. At the distal end of pump cable 44, a submersible pump 46 is operatively connected. Intermediate the opposite ends of pump cable 44 and between the battery 34 and the pump 46, is connected fuse 35 and off/on switch 37. In the specific embodiment illustrated, fuse 35 is secured to a terminal of battery 34. Submersible pump 46 has an inlet 48 and a outlet 50. Outlet 50 is provided with a hose connector 52 with a variety of fittings 62.

Figure 2:
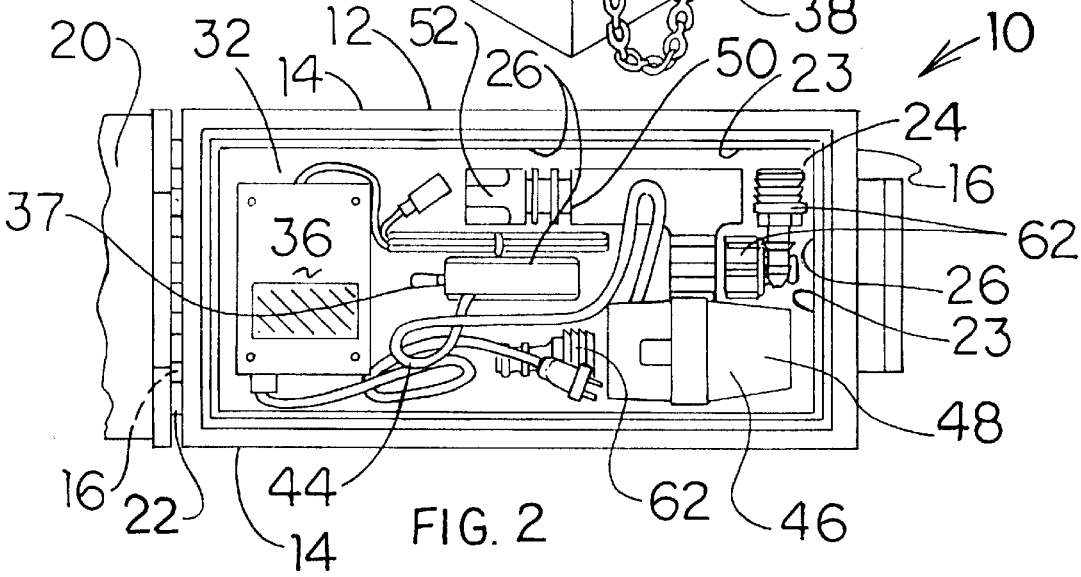
FIG. 2 is a fragmentary top planar view of the portable pump of the invention with the cover in an open condition and the false bottom in place.
Figure 3:
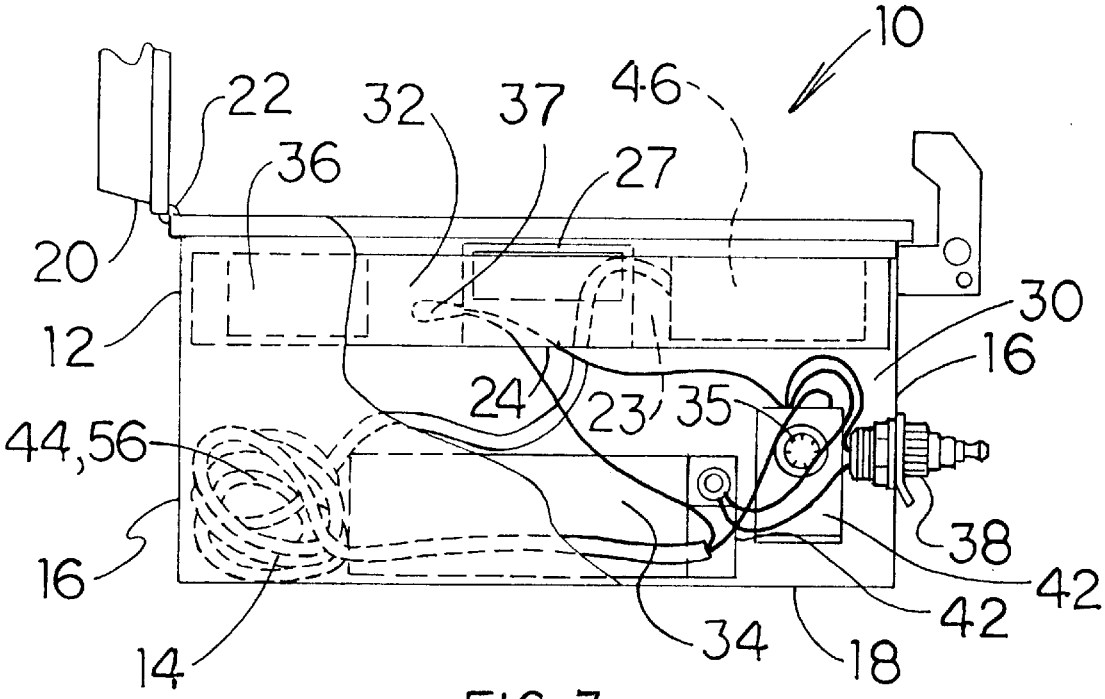
FIG. 3 is a side view of the portable pump of the invention with the top open and the side broken away for clarity.
Figure 4:
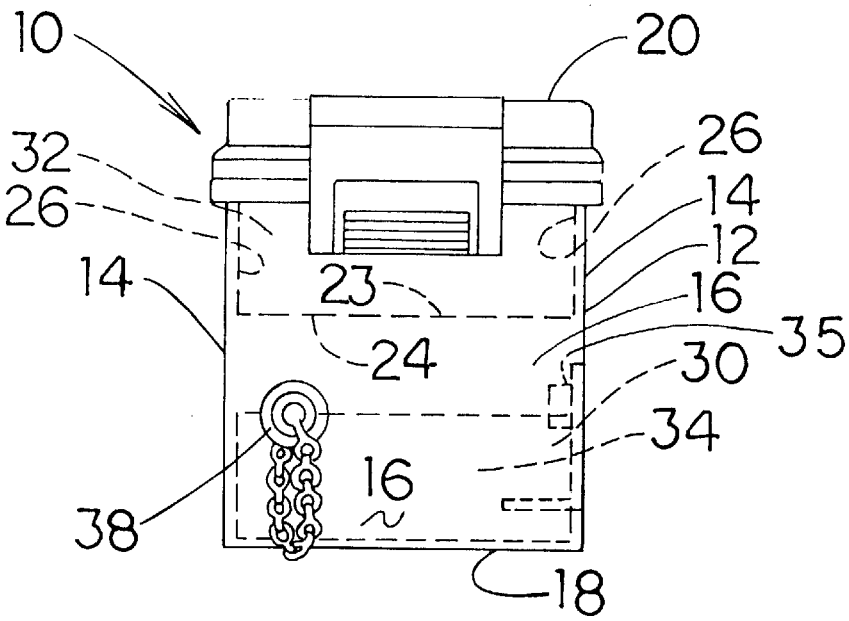
FIG. 4 is an end view of the portable pump of the invention with the pump with the cover closed.
Figure 5:
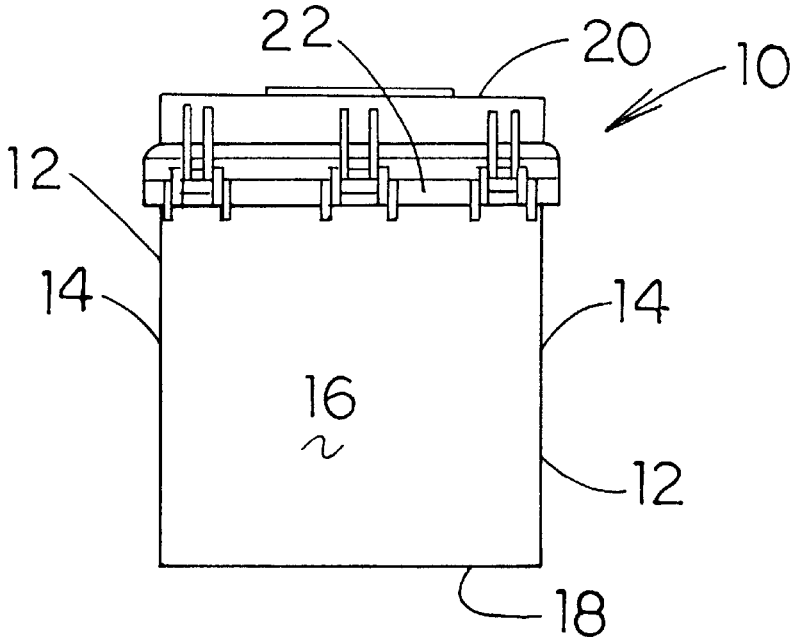
FIG. 5 is a view like FIG. 4 of the opposite end of the portable pump of the invention.
Figure 6:
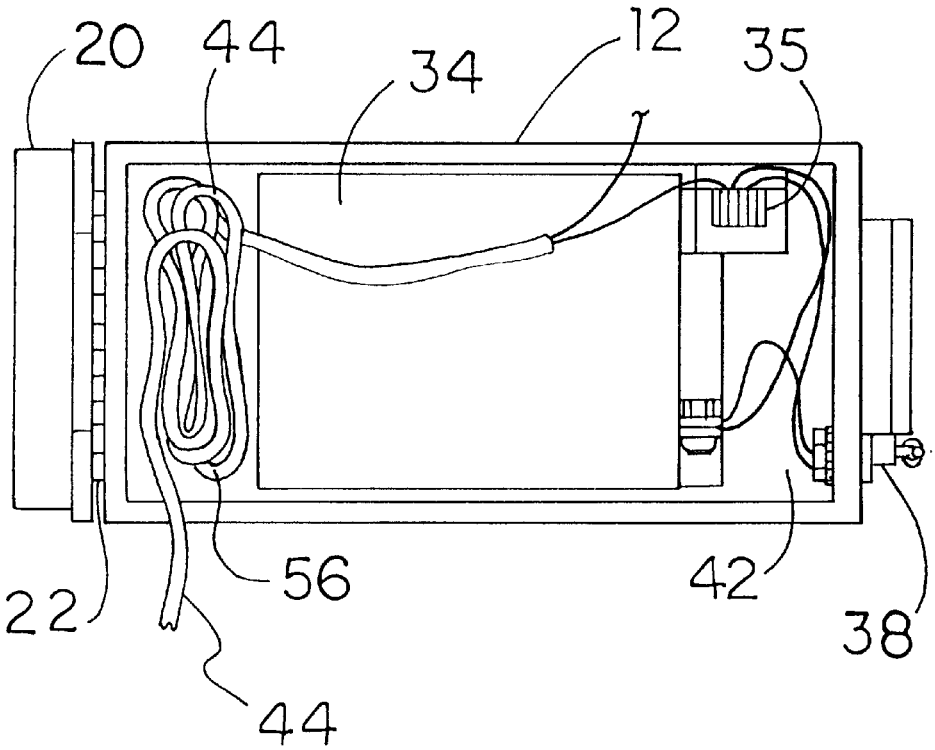
FIG. 6 is a fragmentary top planar view of the portable pump of the invention like FIG. 2 with the false bottom removed for easy viewing.
Figure 7:
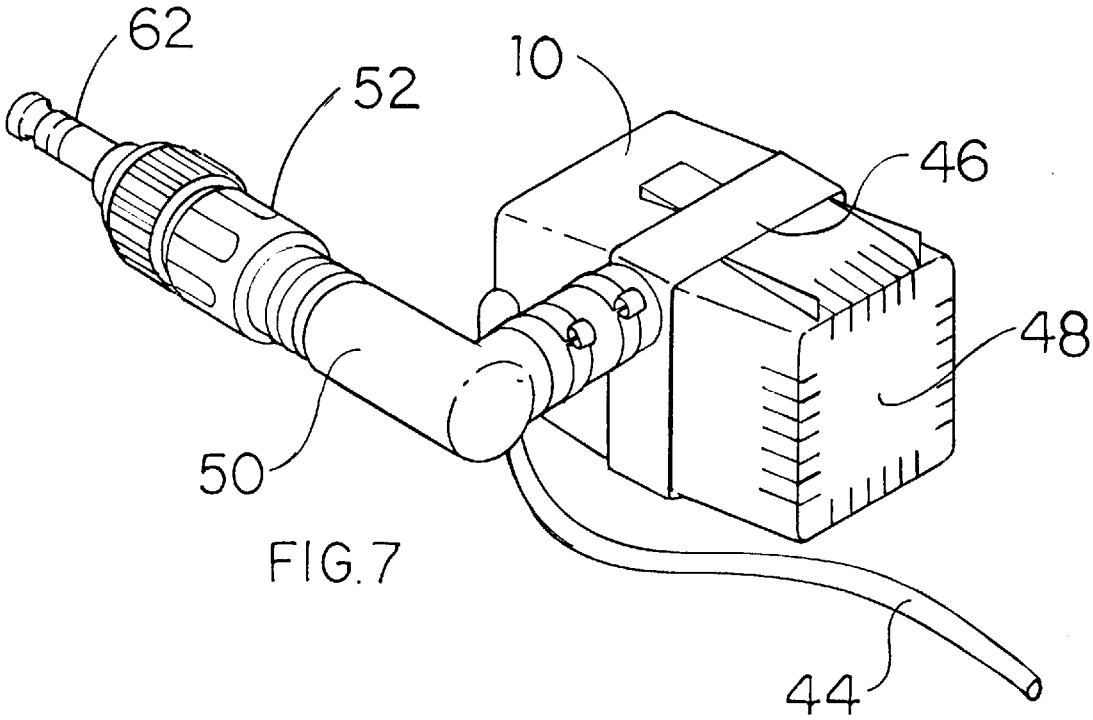
FIG. 7 is a fragmentary perspective view of the submersible pump showing the hose connections thereon.
Figure 8:
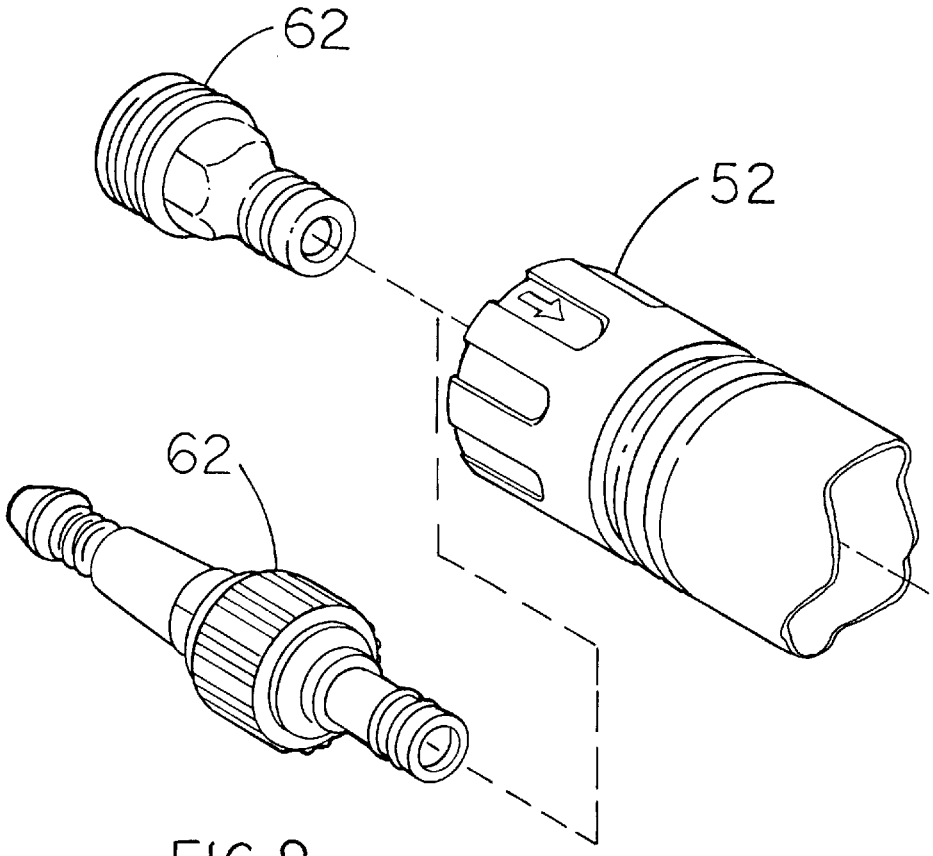
FIG. 8 is a perspective view of the hose connector of the invention.

As shown in FIGS. 2–4, with the tray 23 positioned within the box 12, tray 23 rests over the battery 34 to present an empty tray through which pump cable 44 extends. Tray 23 as shown has an opening or slot 28 therein through which pump cable 44 extends and a handle 27 which extends upwardly of tray 23 and over opening 28. In the specific embodiment illustrated, switch 37 is secured to handle 27 to extend outwardly therefrom and be engageable by the thumb of a hand having the finger thereof wrapped around the handle.

As shown in FIG. 2 in dashed lines, trickle charger 36 may be stored adjacent one end 16 of the tray 23, and the pump 46 may be stored adjacent the opposite end 16 of the tray 23 and room is left in tray 23 for an assortment of hose connector fittings 62. A coil 56 of cable 44 may be stored both in lower portion 30 and upper portion 32 of box 12.

In specific embodiments, the box 12 is rectangular in shape and may have a length from about 14 to about 15 inches, a width from about 8 to about 9 inches, and a depth from about 8 to about 9 inches. Tray 23 may have a width from about 7 to about 8 inches, a length from about 13 to about 14 inches, and upstanding sides of from about 1½ to about 2½ inches. Opening 28 in the bottom 24 may be rectangular having a width from about ¾ to about 1¼ inches, and a length from about 2½ to about 3½ inches allowing opening 28 to accommodate pump cable 44. Handle 27 extends the entire length of opening 28 and is supported at the ends of opening 28 from about 2¼ to about 2¾ inches above the bottom 24 of tray 23.

In specific embodiments, box 12 and tray 23 can be made of metal or suitable plastic materials. In specific embodiments, battery 34 may be a Jellcell 12 volt rechargeable battery, trickle charger 34 may be 12 volt, 12 amp, 24 watt, 120 volt, 60 Hz self-regulating charger, and connector 38 may be a 2 prong self aligning connector, and pump 46 may be a 2 volt sump pump, 15 gpm. Connecting cables 40, 42, 49 may be heat shrunk and waterproof. Switch 37 may be a waterproof toggle switch. In specific embodiments, hose connector 52 may have a plurality of conventional quick connect hose fittings 62.

In a specific embodiment in which box 12 and tray 23 are plastic and have the dimensions, pump, battery and charger above-described, the new and improved pump 10 of the invention weighs from about 15 to about 25 pounds.

In operation, the new and improved portable pump 10 may be carried around in a fully enclosed box 12 from site to site conveniently as a tool box. Whenever the pump is used, box 12 may be opened and pump 46 may be pulled from the box by the length of cable 44. Cable 44 may have a length in a specific embodiment less than that limited by the lift of the pump used as a hose usually needs to be connected to pump outlet 50 of about the same length as cable 44. In the specific embodiment in which a 2 volt, 5 amp, 10–15 gpm pump is used, cable 44 is usually limited to about 10 feet.

A hose is connected to hose connector 52 of the outlet 50 and the pump is submersed as desired. Pump 46 generally has the capability of pumping 10 to 15 GPM for short periods of time for a period of about 3 hours, as desired, per battery charge. Of course, pump 46 may be run for indefinite periods of time with charger 36 attached to battery 34 and a conventional 115–120 volt power source.

The pump 10 can be used powered by the battery 34 or connected to a 115–120 volt alternating power source as desired and as the conditions permit. Whenever the battery 34 is fully discharged, in a specific embodiment, battery 34 can be fully charged in about 6 hours.

As provided, the new and improved portable pump of the invention is easily transportable by a single person, from location to location at which the pump is used, yet is durable enough to be used for extended use and to have the durability and capacity for commercial use by contractors and emergency personnel, is a submersible pump with a capacity from about 10 to about 15 gallons per minute and is driven by an electric motor and yet safe to use in flooded conditions. The electric motor is driven by a rechargeable storage battery, and in a specific embodiment, the new and improved portable pump of the invention has all of the above functionality and a size and weight that is no larger than a conventional tool box.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A portable pump comprising a box having a bottom and upstanding sides and an open top, said box having a false bottom dividing said box into a lower portion and an upper portion, a box cover for closing said open top, a rechargeable electric battery positioned in said lower portion of said box, an electrical power line connector secured to said box and operatively connected to said battery, a charger being operatively connectable to said power line connector and said battery, an electric water pump operatively connected to said battery, said water pump having an inlet and an outlet, said water pump having an outlet hose connector, said upper box portion dimensions having a size to allow said pump and charger to be stored in said upper box portion.

2. The portable pump of claim 1 wherein said box is of the size of a conventional tool box.

3. The portable pump of claim 1 wherein said lower portion is larger than the dimensions of said battery.

4. The portable pump of claim 1 wherein said upper box portion has sufficient space to store both said pump and charger.

5. The portable pump of claim 1 wherein said outlet connector is chosen from the group consisting of threaded connectors, threadless connectors, and quick connect and disconnect connectors.

6. The portable pump of claim 1 wherein said battery and said pump have a power cord extending therebetween, said power cord being sufficiently long to allow positioning of the pump at the site that the pump is used remote from the box, but shorter than the length of the hose to be connected to said hose connector which would equal the lift of said pump.

7. The portable pump of claim 6 wherein storage for said power cord is provided in said bottom box portion.

8. The portable pump of claim 6 wherein storage for said power cord is provided in said top box portion.

9. The portable pump of claim 6 wherein said power cord extends between said top and bottom portions through said false bottom.

10. The portable pump of claim 1 wherein said pump is a submersible pump.

11. The portable pump of claim 1 wherein said power line connector is chosen from the group of couplings consisting of two prong, three prong and single prong waterproof couplings.

12. A portable pump comprising a box having a bottom and upstanding sides and an open top, said box having a false bottom dividing said box into a lower portion and an upper portion, a box cover for closing said open top, a rechargeable electric battery positioned in said lower portion of said box, an electrical power line connector secured to said box and operatively connected to said battery, a charger operatively connectable to said power line connector and said battery, an electric water pump operatively connected to said battery, said water pump having an inlet and an outlet, said water pump having an outlet hose connector, said upper box portion dimensions having a size to allow said pump and charger to be stored in said upper box portion, said lower portion being larger than the dimensions of said battery.

13. The portable pump of claim 12 wherein said outlet connector is chosen from the group consisting of threaded connectors, threadless connectors, and quick connect and disconnect connectors.

14. The portable pump of claim 12 wherein said power line connector is chosen from the group of couplings consisting of two prong, three prong and single prong waterproof couplings.

15. The portable pump of claim 12 wherein said pump is a submersible pump.

16. The portable pump of claim 12 wherein said box is of the size of a conventional tool box.

17. The portable pump of claim 12 wherein said lower portion is generally the dimensions of said battery and a coil of pump cable.

18. The portable pump of claim 12 wherein said upper box portion has sufficient space to store said pump, fittings and charger.

19. The portable pump of claim 12 wherein said power cord extends between said top and bottom portions through said false bottom, and storage for said power cord is provided in both said top and bottom portions of said box.

* * * * *